US006677836B2

(12) United States Patent
Uchiyama et al.

(10) Patent No.: US 6,677,836 B2
(45) Date of Patent: Jan. 13, 2004

(54) DIELECTRIC FILTER DEVICE HAVING CONDUCTIVE STRIP REMOVED FOR IMPROVED FILTER CHARACTERISTICS

(75) Inventors: Takaaki Uchiyama, Higashiosaka (JP); Katsumi Umeda, Katano (JP); Kenichi Ezaki, Daito (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 0 days.

(21) Appl. No.: 10/230,370

(22) Filed: Aug. 29, 2002

(65) Prior Publication Data

US 2003/0201849 A1 Oct. 30, 2003

(30) Foreign Application Priority Data

Apr. 25, 2002 (JP) ..... 2002-124734

(51) Int. Cl.[7] ..... H01P 5/12; H01P 3/06; H01P 1/20

(52) U.S. Cl. ..... 333/206; 333/134

(58) Field of Search ..... 333/134, 206, 333/202, 135, 207; 29/600; 343/702, 909

(56) References Cited

U.S. PATENT DOCUMENTS 6,154,951 A * 12/2000 Ito et al. ..... 29/600
6,377,132 B1 * 4/2002 Wakamatsu et al. ..... 333/134
6,525,625 B1 * 2/2003 Tsukamoto et al. ..... 333/134

FOREIGN PATENT DOCUMENTS

JP 3205337 6/2001
WO WO 93/24968 12/1993

* cited by examiner

*Primary Examiner*—Patrick Wamsley
(74) *Attorney, Agent, or Firm*—Armstrong, Kratz, Quintos, Hanson & Brooks, LLP

(57) ABSTRACT

The invention provides a dielectric filter device having first bore opening portions arranged between a first electrode formed on an upper surface or side surface of a dielectric block and a second electrode formed on the upper surface to provide a filter for passing a predetermined frequency band, and a second bore opening portion disposed between the second electrode and the side surface of the block. A conductive layer on the outer peripheral side surface close to the second electrode is removed in the form of a strip from at least one portion of the peripheral side surface which portion extends from the upper surface to the lower surface of the block. Unnecessary resonance in a high frequency range outside the pass band can be suppressed without providing an external circuit.

6 Claims, 8 Drawing Sheets

DIELECTRIC FILTER DEVICE HAVING CONDUCTIVE STRIP REMOVED FOR IMPROVED FILTER CHARACTERISTICS

FIELD OF THE INVENTION

The present invention relates to dielectric filter devices for determining the frequency band pass characteristics to be used in mobile communications devices or the like.

BACKGROUND OF THE INVENTION

It is generally known that monoblock-type dielectric filters are used in mobile communications devices for transmitting and receiving signals, for example, in the frequency band of hundreds of megahertz to several gigahertz, Mobile communications devices, such as portable telephones, in recent years are adapted to serve a multiplicity of functions and made more compact and lightweight, and many monoblock-type dielectric duplexers are singly adapted to process different transmission and receiving frequencies for use in such devices (for example, Japanese Patent No. 3205337).

An example of duplexer which is such a conventional dielectric filter of the monoblock type will be described with reference to FIG. 9. A dielectric block 10, for example, of a ceramic material or the like has hollow bores 40 to 44, 49, 50. Electrically conductive layers are formed on the outer peripheral side surface 20 of the block and the upper surface thereof around the openings of the bores as indicated at 33 to 39. Further provided on the upper surface are a first electrode 30, second electrode 31 and third electrode 32 which are separate from these conductive layers.

As shown in FIG. 9, the bores 40, 41 are arranged between the first electrode 30 and the second electrode 31. The bore 49 is positioned between the second electrode 31 and the peripheral side surface. The bores 42 to 44 are arranged between the first electrode 30 and the third electrode 32. The bore 50 is positioned between the third electrode 32 and the peripheral side surface 20. The first electrode 30 is connected to an antenna (not shown), the second electrode 31 to a transmitter, and the third electrode 32 to a receiver.

A band-pass filter for the desired transmission frequency band is provided by suitably adjusting the dimensions and shapes (e.g., the diameter and depth of bores, and distance between conductive layers) of the bores 40, 41 between the first and second electrodes 30, 31, the conductive layers 33, 34 in the vicinity of openings of these bores, and conductive layers 60, 62 joined to the outer peripheral side surface 20. A trap having an attenuation pole at the desired frequency in the vicinity of the above-mentioned transmission frequency band can be provided by suitably adjusting the dimensions and shapes of the bore 49 between the second electrode 31 and the conductive layer on the peripheral side surface 20, the conductive layer 38 in the vicinity of opening of the bore, and the conductive layer 62 joined to the peripheral side surface 20.

Similarly, a predetermined band-pass filter for the receiving frequency band is provided by suitably adjusting the dimensions and shapes of the bores 42 to 44 between the first and third electrodes 30, 32, the conductive layers 35 to 37 in the vicinity of openings of these bores and the conductive layers 60, 62 joined to the peripheral side surface 20. A trap having an attenuation pole in the vicinity of the receiving frequency band can be provided by suitably adjusting the shapes of the bore 50 between the third electrode 32 and the conductive layer on the peripheral side surface, the conductive layer 39 in the vicinity of opening of the bore and the conductive layer 62 joined to the peripheral side surface 20.

The dielectric duplexer described comprises two dielectric filters having two systems, i.e., transmitting system and receiving system, which use different frequencies. Since the filters are based on the same principles of the band-pass function and the trap function, these functions will be described in respect of the receiving system with reference to the filter characteristics diagrams of FIG. 8.

FIG. 8 shows the characteristics of the receiving band-pass filter which is capacitance-coupled by the bores provided between the first electrode and the third electrode and the conductive layers in the vicinity of these bores. The shapes of these bores, the conductive layers in the vicinity of the openings thereof and the conductive layer 61 joined to the peripheral side surface 20 are so adjusted as to provide the desired frequency pass band as illustrated. Although the function of trap afforded by the bore between the third electrode 32 and the peripheral conductor is so designed as to attenuate frequencies outside the pass band, it is extremely difficult to attenuate the entire higher frequency band outside the pass band. Thus, it is likely that a resonance mode such as a or b will project in the higher frequency attenuation band outside the pass band. This appears attributable to the presence of the second or third harmonic of the main resonance mode other than the main resonance mode which determines the pass band of the dielectric filter or dielectric duplexer, or to the presence of other resonance mode such as TM mode or TE mode. With communications devices, however, it is required that the attenuation characteristics of a higher band of the dielectric filter be reduced to the greatest possible extent.

In the field of mobile communications devices such as portable telephones, it is required in recent years that the parts be made ever smaller. Since mobile phones need to be highly portable as an important feature of the commercial product and must therefore be smaller in size, it is not desirable to provide improved filter characteristics by adding anew circuit components to the dielectric filter described.

SUMMARY OF THE INVENTION

To overcome the foregoing problems, the present invention provides a dielectric filter device comprising a dielectric block generally in the form of a rectangular parallelepiped and having a plurality of hollow bores formed therein and openings of the bores in an upper surface of the block, electrically conductive layers respectively covering a lower surface opposed to the upper surface, an outer peripheral side surface parallel to axes of the bores, inner peripheral surfaces defining the respective bores and the upper surface around the bore openings, and a plurality of electrodes separate from the conductive layers for connection to external devices, the dielectric filter device being characterized in that the conductive layer is removed in the form of a strip from at least one portion of the peripheral side surface.

In the dielectric filter device, the conductive layer removed portion of the peripheral side surface has one end continuous with the upper surface.

Further in the dielectric filter device, the conductive layer removed portion of the peripheral side surface has one end continuous with the upper surface and the other end continuous with the lower surface.

The dielectric filter can be given improved characteristics by the present invention without providing external parts on the filter.

DETAILED DESCRIPTION OF EMBODIMENTS

Figure 1:
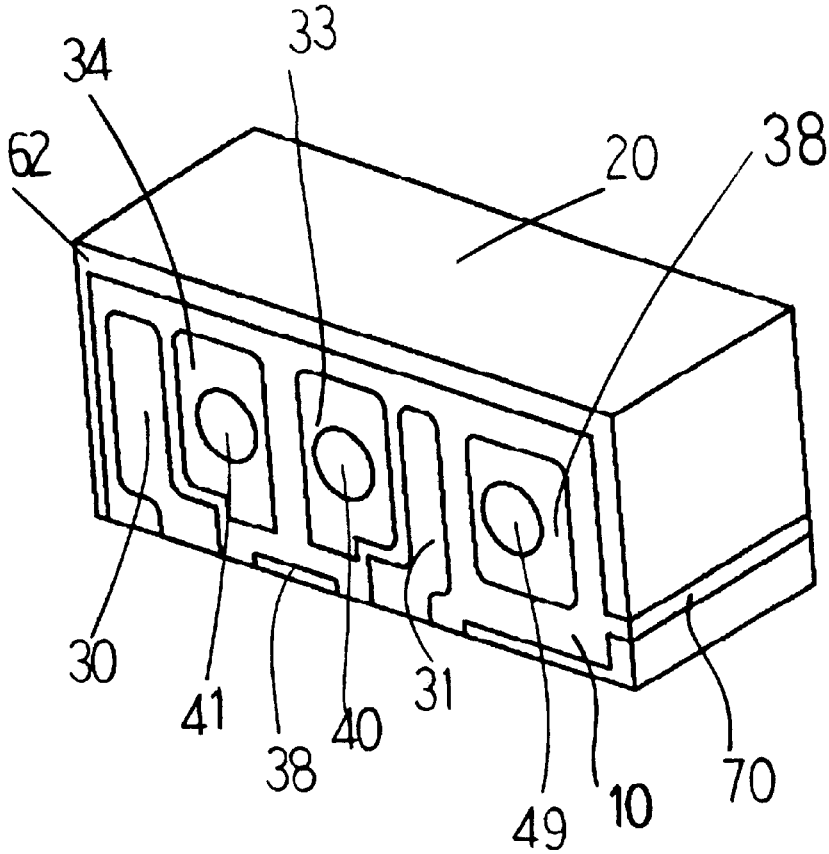
FIG. 1 is a perspective view showing a dielectric filter of the present invention.

Embodiments of the present invention will be described below with reference to FIGS. 1 to 6 and FIGS. 10 and 11. The dielectric filter which is the basic device of the invention comprises a dielectric block 1 prepared from a ceramic material or the like and having hollow bores 40, 41, 49. Conductive layers are formed on the outer peripheral side surface 20 of the block 1 and in the vicinity of openings of the bores in the upper surface thereof as indicated at 33, 34, 38. A first electrode 30 and a second electrode 31 which are electrically separate from the conductive layers are formed on the upper surface.

Openings of the bores 40, 41 are arranged between the first and second electrodes 30, 31. An opening of the bore 49 is disposed between the second electrode 31 and the peripheral side surface 20. The conductor on the peripheral side surface in the vicinity of the conductive layer 38 around the opening of the bore 49 is removed from the peripheral surface in the form of a strip extending from the upper surface to the lower surface as indicated at 70.

The first electrode 30 is connected to an antenna (not shown), and the second electrode 31 to a receiver. A band-pass filter is provided by the bores 40, 41 arranged between the first and second electrodes 30, 31 and the conductive layers 33, 34 around the openings of the bores. The frequencies of the desired pass band are determined by suitably adjusting the shape of the bores and the shape of the conductive layers 38, 62. The conductor 38 is capacitance-coupled to the bores 40, 41 to adjust the frequencies of the pass band. The bore 49 is formed between the second electrode 31 and the conductive layer on the peripheral side surface 20. The bore 49 provides a trap for the second electrode, near frequencies of the pass band. Further the suitable removal of the conductive layer from the peripheral side surface as indicated at 70 inhibits the second or third harmonic of the main resonance mode or an unnecessary resonance mode, such as TM mode or TE mode, to give improved high frequency characteristics to the dielectric filter.

Figure 8:
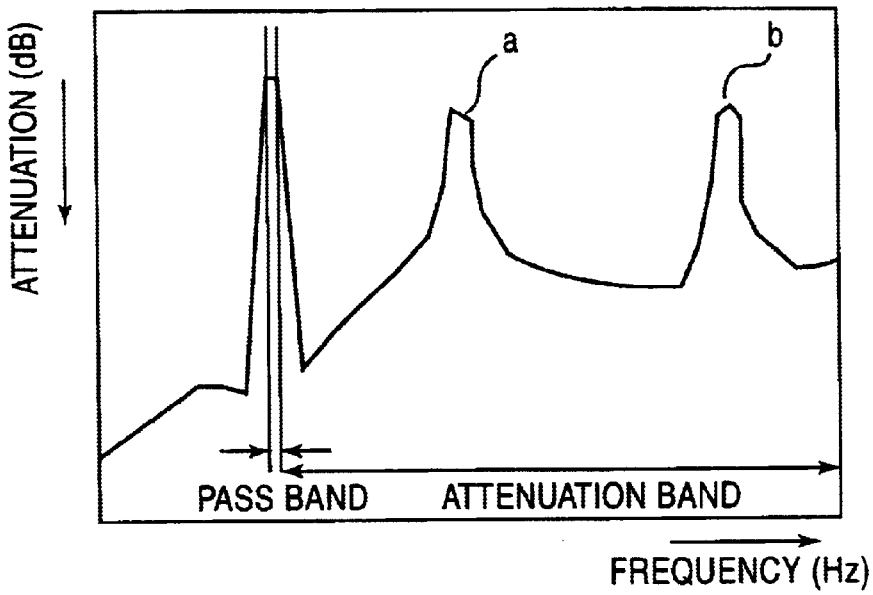
FIG. 8 PRIOR ART
FIG. 8 is a graph showing the characteristics of a conventional dielectric filter.
Figure 9:
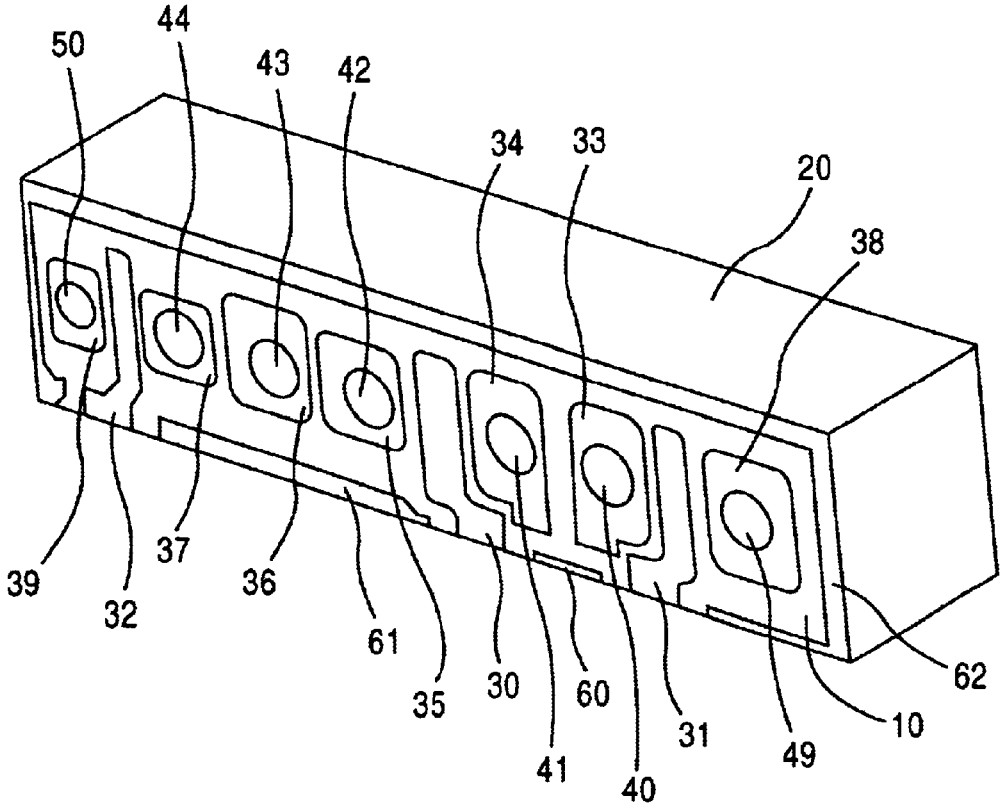
FIG. 9 PRIOR ART
FIG. 9 is a perspective view showing the conventional dielectric filter.

FIG, 7 shows the characteristics of the filter of FIG. 1, indicating that the peaks a1, b1 due to the unnecessary resonance mode present in the suppression band are attenuated unlike the conventional characteristics shown in FIG. 8.

Figure 2:
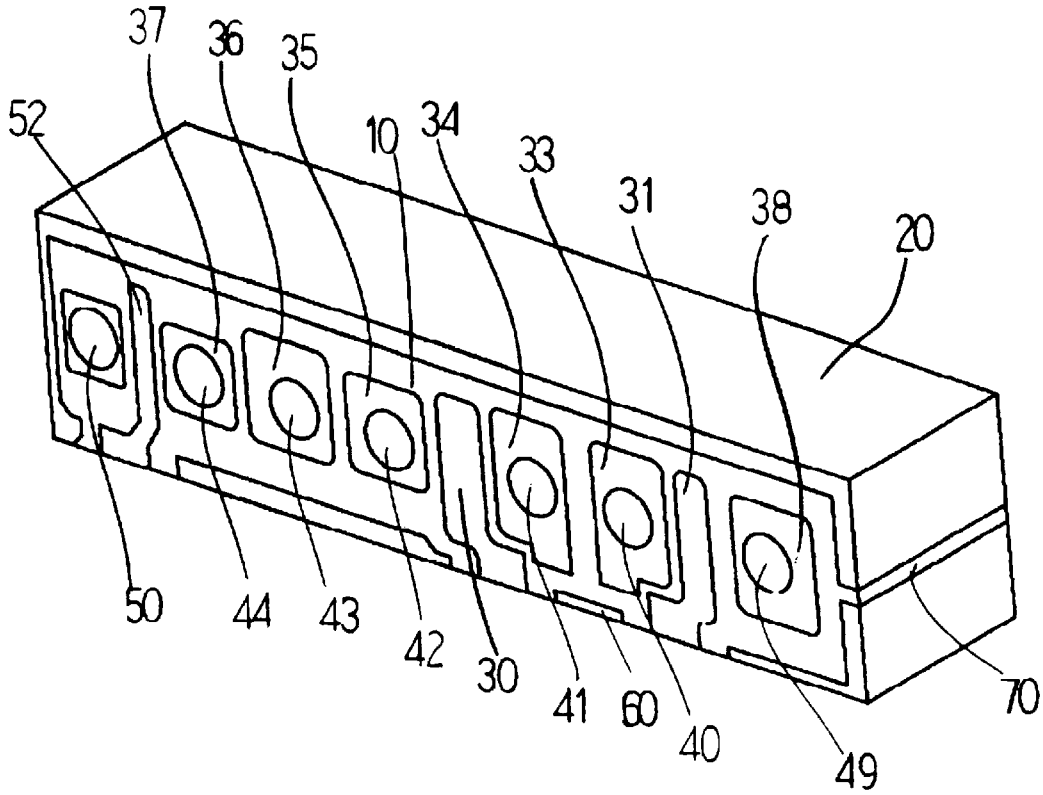
FIG. 2 is a perspective view showing a duplexer comprising the dielectric filter of FIG. 1.

FIG. 2 shows an example of application of the dielectric filter of FIG. 1 to a dielectric duplexer. The device comprises a unit of transmitting and receiving filters each provided by the filter of FIG. 1. A plurality of hollow bores 40, 41 are arranged between a first electrode 30 and a second electrode 31. A hollow bore 49 is disposed between the second electrode 31 and the outer peripheral side surface of the illustrated block. A plurality of hollow bores 42 to 44 are arranged between the first electrode 30 and a third electrode 32. A hollow bore 50 is disposed between the third electrode 32 and the outer peripheral side surface 20.

For example, the first electrode 30 is connected to an antenna (not shown), the second electrode 31 to a transmitter, and the third electrode 32 to a receiver. A band-pass filter of the desired transmission frequency band is provided by suitably adjusting the dimensions and shapes (e.g., the diameter and depth of bores, and distance between conductive layers) of the bores 40, 41 between the first and second electrodes 30, 31 and the conductive layers 33, 34 in the vicinity of openings of these bores and thereby providing capacitance-coupled resonators. Traps having attenuation poles at desired frequencies in the vicinity of the above-mentioned receiving frequency band can be provided by suitably adjusting the shapes of the bore 49 between the second electrode 31 and the conductive layer on the peripheral side surface 20 and the conductive layer 38 around the opening of the bore.

Similarly, a predetermined band-pass filter for the transmission frequency band is provided by suitably adjusting the dimensions and shapes of the bores 42 to 44 between the first and third electrodes 30, 32 and the conductive layers 35 to 37 in the vicinity of openings of these bores. Traps can be provided in the vicinity of the transmission frequency band by suitably adjusting the shapes of the bore 50 between the third electrode 32 and the conductive layer on the peripheral side surface and the conductive layer 39 around the opening of the bore.

Further the removal of the conductive layer from the peripheral side surface as indicated at 70 makes it possible to adjust the electromagnetic coupled state of the dielectric filter, and to inhibit the second or third harmonic of the main resonance mode or an unnecessary resonance mode, such as TM mode or TE mode, consequently giving improved high frequency characteristics to the dielectric filter.

Figure 10:
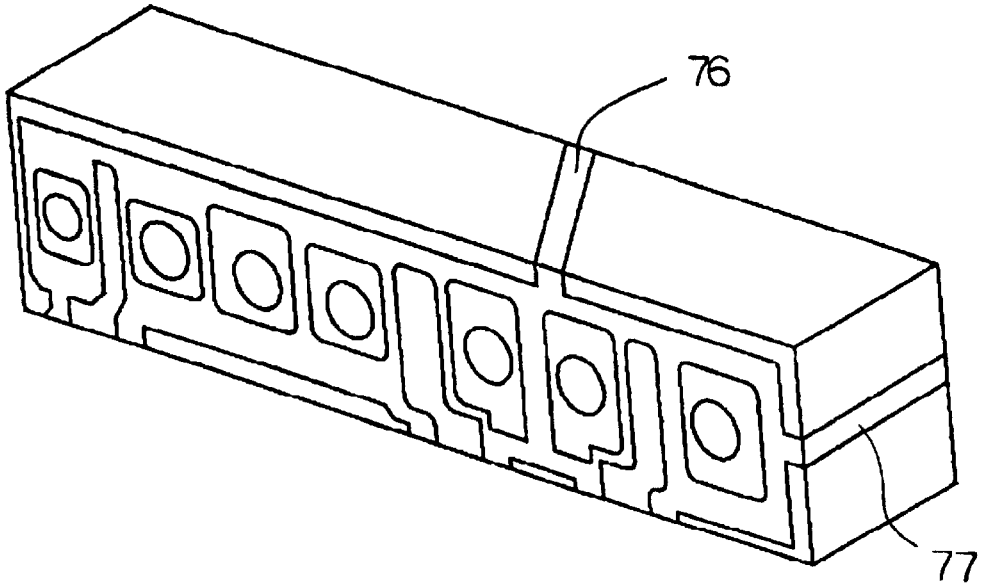
FIG. 10 is a perspective view showing another embodiment of duplexer comprising the dielectric filter of FIG. 1.
Figure 11:
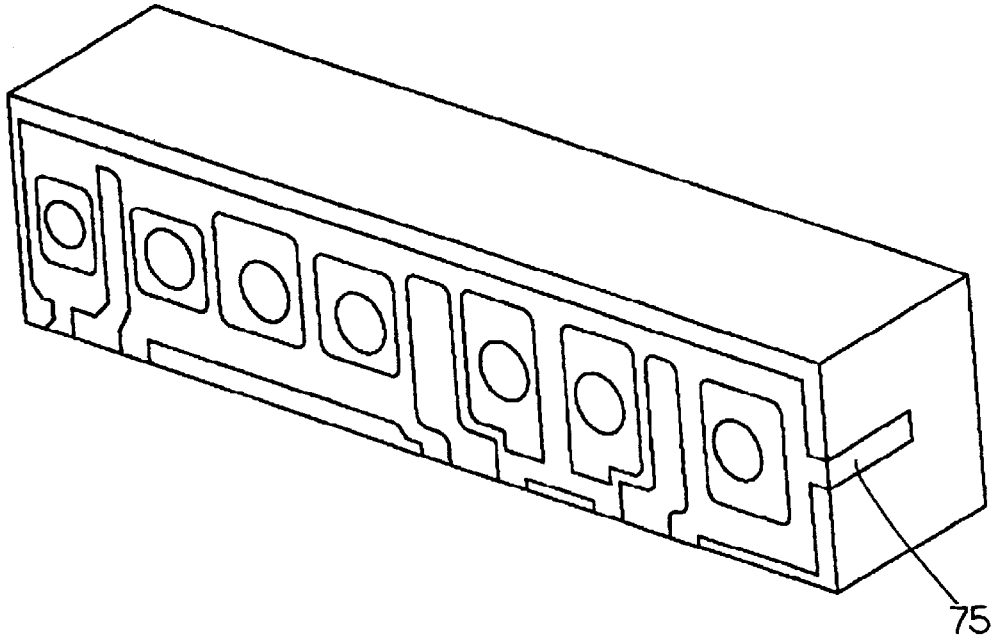
FIG. 11 is a perspective view showing another embodiment of duplexer comprising the dielectric filter of FIG. 1.

Although the conductive layer is locally removed from the outer peripheral side surface in the form of a straight line in FIGS. 1 and 2, the conductive layer may be removed from a plurality of portions 76, 77 of peripheral side surface extending from the upper surface to the lower surface obliquely or in parallel to the hollow bore axis as shown in FIG. 10. Alternatively as seen in FIG. 11, the conductive layer may be removed from a portion 75 of the peripheral side surface which portion 75 extends from the upper surface to an intermediate portion of the side surface.

Figure 3:
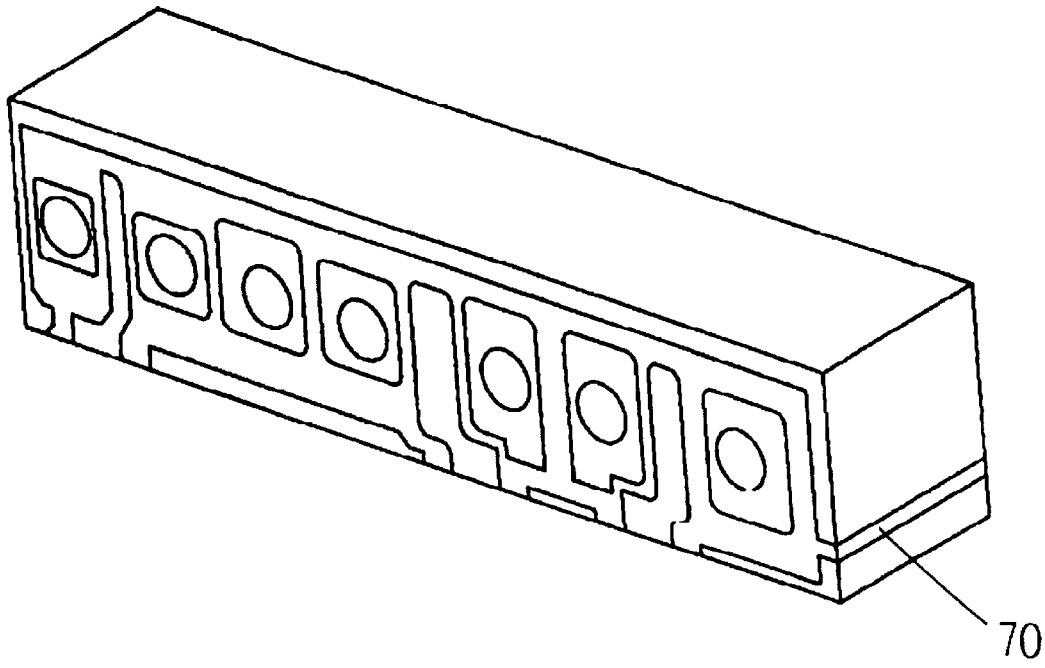
FIG. 3 is a perspective view showing another embodiment of duplexer comprising the dielectric filter of FIG. 1.
Figure 4:
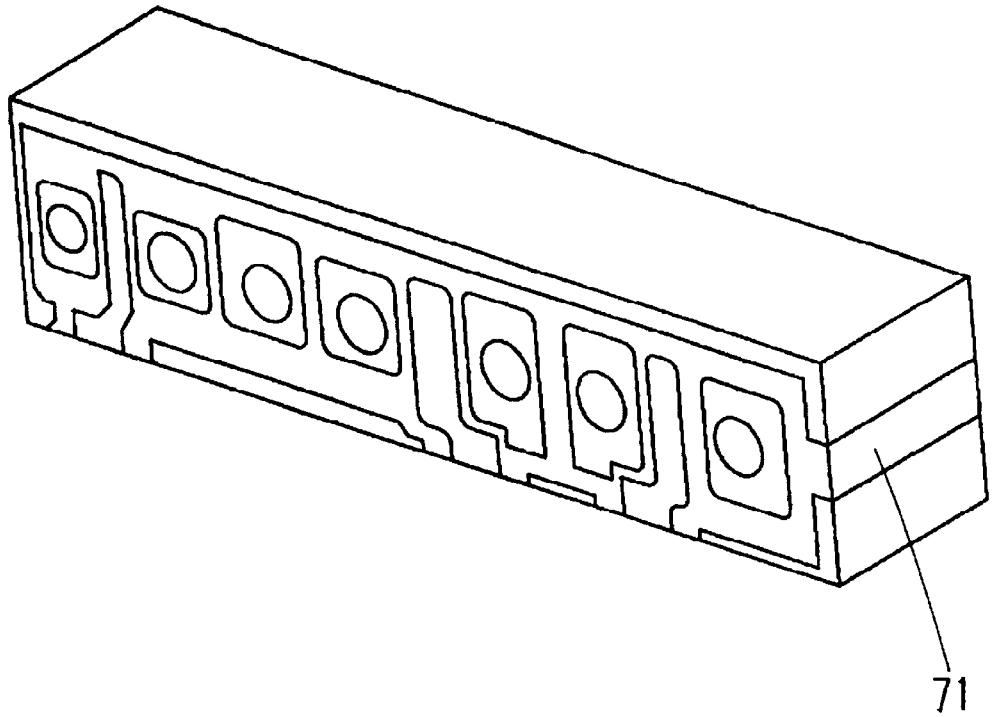
FIG. 4 is a perspective view showing another embodiment of duplexer comprising the dielectric filter of FIG. 1.
Figure 5:
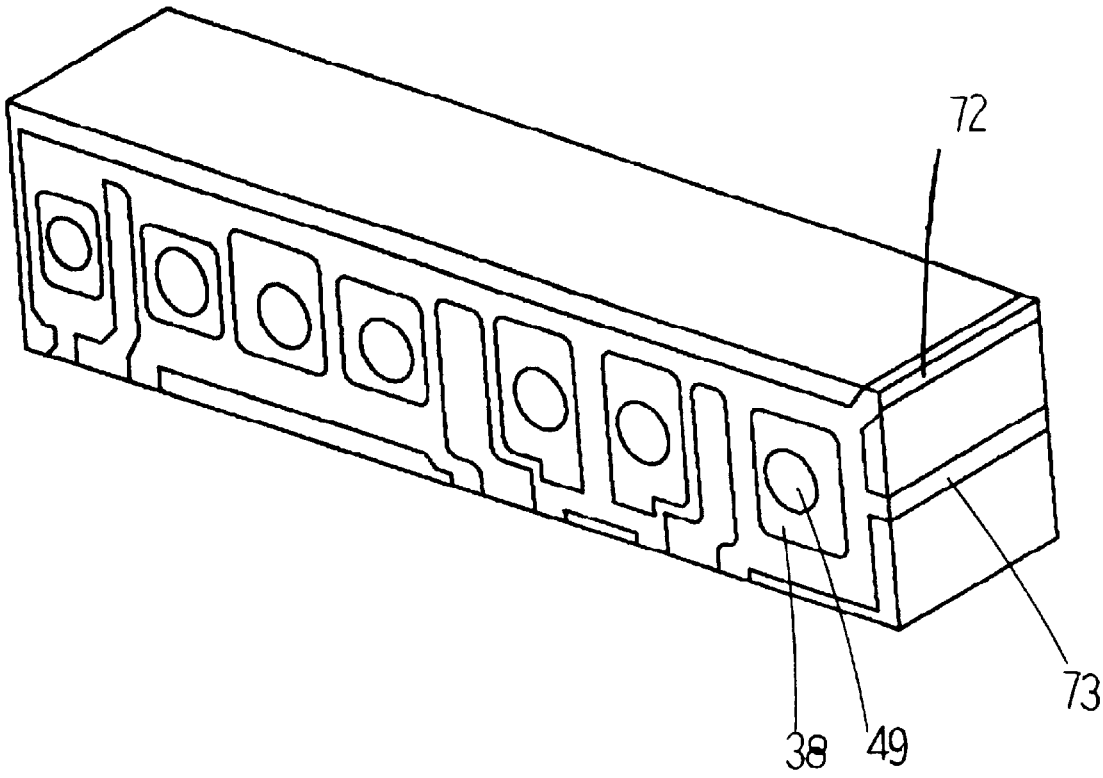
FIG. 5 is a perspective view showing another embodiment of duplexer comprising the dielectric filter of FIG. 1.
Figure 6:
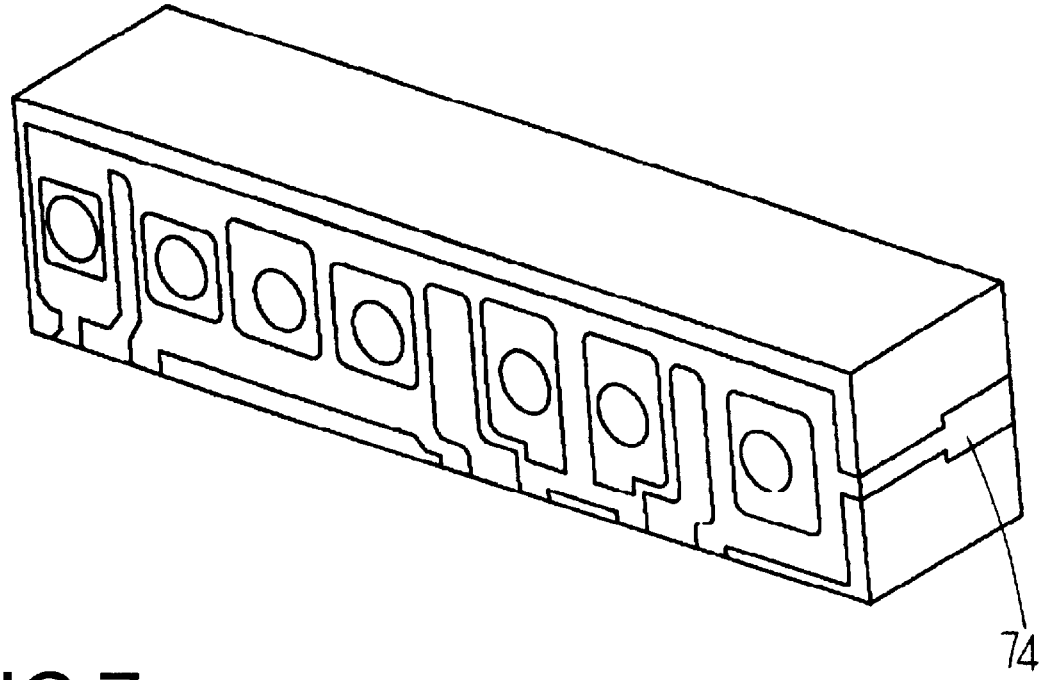
FIG. 6 is a perspective view showing another embodiment of duplexer comprising the dielectric filter of FIG. 1.
Figure 7:
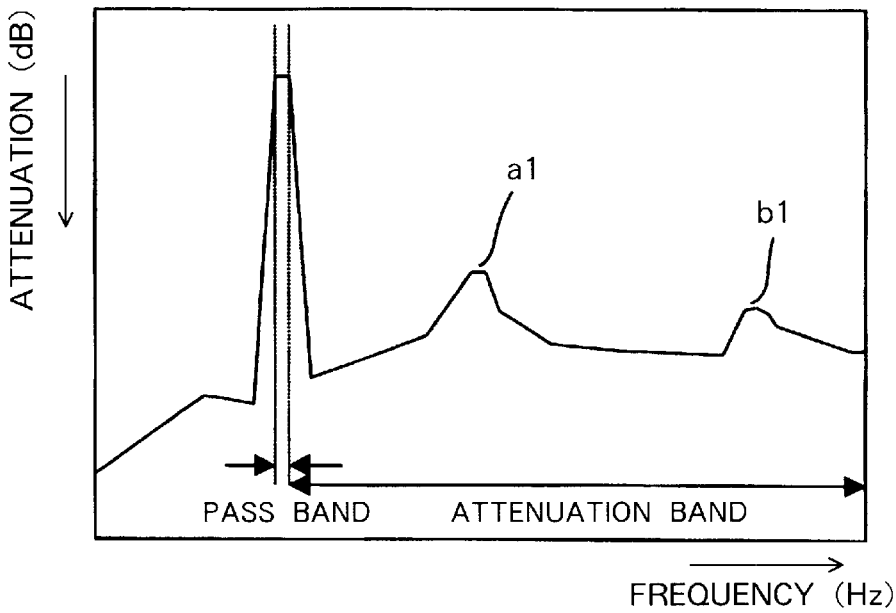
FIG. 7 is a graph showing the characteristics of the dielectric filter of the invention.

The device of the present invention is not limited to the foregoing embodiments but can be modified variously within the technical scope as defined in the appended claims. For example, the conductor removed portion of the outer peripheral side surface may be positioned at a lower level as illustrated in FIG. 3. Alternatively, the conductor removed portion of the peripheral side surface may have an increased width as indicated at 71 in FIG. 4. Further alternatively, a conductor removed portion 72 may be positioned at a corner of the peripheral side surface to provide a plurality of removed portions 72, 73 as shown in FIG. 5, or the peripheral side surface may have a removed portion 74 having an altered width at an intermediate part thereof as seen in FIG. 6.

In any of the embodiments of the invention, the outer peripheral side surface of the block has a conductor removed portion of suitably altered shape to thereby suitably adjust the capacitance coupling or dielectric coupling of the hollow bore and the conductive layer around the bore, or the electrode and the conductive layer on the peripheral side surface to thereby suppress the second or third harmonic of the main resonance mode or unnecessary resonance in a higher frequency range of the pass band due to TE mode or TM mode, giving improved attenuation characteristics to the filter.

What is claimed is:

1. A dielectric filter device comprising a dielectric block generally in the form of a rectangular parallelepiped and having a plurality of hollow bores formed therein and openings of the bores in an upper surface of the block, electrically conductive layers respectively covering a lower surface opposed to the upper surface, an outer peripheral side surface parallel to axes of the bores, inner peripheral surfaces defining the respective bores and the upper surface around the bore openings, and a plurality of electrodes separate from the conductive layers for connection to external devices, the dielectric filter device being characterized in that the conductive layer is removed in the form of a strip from at least one portion of the peripheral side surface.

2. A dielectric filter device according to claim 1 wherein the conductive layer removed portion of the peripheral side surface has one end continuous with the upper surface.

3. A dielectric filter device according to claim 2 wherein the conductive layer removed portion of the peripheral side surface has one end continuous with the upper surface and the other end continuous with the lower surface.

4. A dielectric filter device comprising a dielectric block generally in the form of a rectangular parallelepiped and having a plurality of hollow bores formed therein and openings of the bores in an upper surface of the block, electrically conductive layers respectively covering a lower surface opposed to the upper surface, an outer peripheral side surface parallel to axes of the bores, inner peripheral surfaces defining the respective bores and the upper surface around the bore openings, and a plurality of electrodes separate from the conductive layers for connection to external devices, the filter device being characterized in that first bore opening portions are arranged between the first electrode formed on the upper surface or side surface of the block and the second electrode formed on the upper surface thereof, with a second bore opening portion disposed between the first electrode and the third electrode formed on the upper surface, to provide a duplexer for transmitting and receiving a predetermined frequency band, the conductive layer being removed in the form of a strip from at least one portion of the peripheral side surface.

5. A dielectric filter device according to claim 4 wherein the conductive layer removed portion of the peripheral side surface has one end continuous with the upper surface.

6. A dielectric filter device according to claim 5 wherein the conductive layer removed portion of the peripheral side surface has one end continuous with the upper surface and the other end continuous with the lower surface.

* * * * *